United States Patent [19]

Cahill et al.

[11] Patent Number: 5,046,258

[45] Date of Patent: Sep. 10, 1991

[54] WRAPPING MACHINES

[75] Inventors: Michael J. Cahill, Coventry; Dennis Hinchcliffe, Orpington; Jeffrey J. Patchett; Geoffrey W. Vernon, both of Coventry; Peter White, Bristol, all of England

[73] Assignee: Molins PLC, Milton Keynes, England

[21] Appl. No.: 305,345

[22] Filed: Feb. 2, 1989

[30] Foreign Application Priority Data

Feb. 10, 1988 [GB] United Kingdom ..... 8802973

[51] Int. Cl.[5] ..... B65B 11/06

[52] U.S. Cl. ..... 530/230; 53/206; 53/228; 53/388; 53/441

[58] Field of Search ..... 53/133, 206, 228, 230, 53/388, 441

[56] References Cited

U.S. PATENT DOCUMENTS 3,127,722 4/1964 Schoder ..... 53/230

*Primary Examiner*—W. Donald Bray

*Attorney, Agent, or Firm*—John C. Smith, Jr.

[57] ABSTRACT

A wrapping machine, particularly for wrapping cigarette packets in wrapper film, includes a series of endless band conveyors (148, 152, 156, 166, 170) carrying pushers (150, 154, 158, 172) for moving successive packets (191) along a straight wrapping line. One of the pushers (158) is heated to seal a wrapper seam. Opposed heated band conveyors (166) simultaneously seal end folds of the wrapper. Packets are gripped between opposed conveyors (145, 148) immediately after intercepting a wrapper (100). Partially-wrapped packets are arranged to slide relative to surfaces (149, 153, 157, 180) to attain wrap tightness. Successive conveyors (e.g. 156, 170) are independently driven to allow phasing of the conveyors to vary the position at which packets are transferred between them.

17 Claims, 4 Drawing Sheets

WRAPPING MACHINES

This invention relates to wrapping machines, particularly for wrapping cigarette packets in transparent plastics film.

According to one aspect of the invention a wrapping machine includes means for conveying a succession of spaced articles along a path, means for delivering a succession of wrappers to said articles including means for locating a first part of said wrapper with respect to an article moving on said path, and means for causing or tending to cause relative movement of a second part of the wrapper with respect to the article so as to cause or tend to cause the wrapper to be tightened around at least part of the article. In a preferred arrangement the articles are packets and are, for convenience, subsequently referred to as such. Preferably the locating means is part of the means for conveying a packet along the path, and may conveniently comprise a pusher which engages the trailing side of a partially-wrapped packet. The pusher may also serve to fold said first part of the wrapper against said trailing side. The means for causing or tending to cause movement may comprise a surface relative to which the second part of the wrapper moves, the friction between the wrapper and the surface being sufficient to create drag which causes or tends to cause tightening of the wrapper around the packet. The surface may be stationary or may be moving, e.g. part of the wrapper may contact a conveyor moving at a speed which differs from that of the packet. The friction between the surface and the wrapper is preferably relatively low so that there is no risk of marking or otherwise damaging the wrapper. There may be more than one surface. For example, a packet with an enveloping wrapper may pass between upper and lower surfaces each of which tends to tighten the wrapper around the packet. It would be possible to apply light pressure between the surface and the packet to increase the drag effect on the wrapper.

The use of a slide or other surface to ensure wrap tightness is particularly valuable during initial wrapping of the wrapper around the packet. Thus the locating means may be the first fold pusher. Maintaining wrap tightness is, however, important up to the position at which the wrapper is finally sealed. Hence, by using means such as one or more slide surfaces up to and during sealing of at least the first seam of the wrapper, maximum benefit from the invention is obtained. It follows that where the wrapper comprises a thermoplastics material and an overlapped seam of the wrapper is sealed by heat it is preferred to convey the packet by means of a heated pusher which contacts the seam while overcoming slight resistance to motion generated by one or more surfaces such as referred to in the previous paragraph. An additional benefit gained in this case is that the slight friction ensures good contact between the pusher and the seam, so that heat transfer is facilitated.

According to another aspect of the invention a continuous wrapping machine includes at least one pusher for advancing a partially wrapped packet along a substantially straight path, said pusher including means for sealing an overlapped portion of the wrapper during conveyance of the packet by transfer of heat between the pusher and said portion. The sealing may be effected by heating (e.g. of thermosetting or thermoplastic material, which may be the wrapper itself or an applied adhesive). In this case the pusher preferably comprises an electrically-heated element and may cooperate with means for controlling the electric current to the element and so maintaining a temperature range acceptable to the packet and wrapper. It will be understood that in the case of a thermoplastic material the sealing process is analagous to welding, the sealed portions being set by subsequent cooling of the material. With the small quantities of heat which it is generally necessary to apply, this cooling occurs quickly at ambient temperature. In principle cooling pushers could be used, e.g. to cause rapid setting of pre-heated thermoplastic adhesive applied to the wrapper.

According to another aspect of the invention a wrapping machine includes means for moving a succession of spaced packets continuously along a path, and means for delivering a succession of wrappers across said path in timed relationship to said packets so that each wrapper is intercepted by a packet, wherein said moving means comprises opposed conveyors substantially immediately downstream of the position where the packets intercept the wrappers, so that each partially wrapped packet is engaged on opposed surfaces by said conveyors. Said opposed conveyors therefore preferably engage each partially-wrapped packet substantially simultaneously. In contrast to prior art systems where such opposed conveyors (if present at all) are well spaced from the position at which the wrapper is intercepted by the packet, this arrangement retains control of the wrapper as soon as possible after it has been intercepted by the packet and allows it to be contacted by a surface having a speed related to that of the packet: this is particularly advantageous in high speed machines (e.g. machines capable of processing in excess of 400 packets per minute)

According to a further aspect the invention provides a wrapping machine having a substantially straight path along which packets are moved continuously in succession, means for delivering a succession of wrappers so that each wrapper is intercepted by a packet moving on said path, and means for folding and sealing the wrapper around the packet, including a first pusher for moving a packet along said path, and a second pusher for moving a packet along said path, said second pusher being arranged to take over conveyance of a packet on said path from said first pusher, and said first and second pushers having complementary shapes to allow each to have simultaneous and/or extended contact with different parts of said packet. The first and second pushers preferably have constant speeds, the speed of the second pusher being not less than that of the first pusher. At least one of the pushers may perform a folding operation on the wrapper, so that the extended contact with the packet may be at least partially through a folded part of the wrapper and so that said contact may help to hold the folded part in place against the packet. At least one of the pushers may consist of an element intended to transfer heat to (or from) an overlapped seam of a wrapper so as to seal the seam and at least partially complete the sealing of the wrapper around the packet.

According to a still further aspect of the invention successive article conveyors in a machine for wrapping articles, which conveyors have a common path portion, are driven by independent drive means, whereby by control of at least one of said drive means the phase and/or speed of said conveyors may be varied, particularly so that the position at which an article is transferred between said conveyors may be varied. In this way the period during which an article is contacted by a conveyor may be controlled. For example, where the machine is of variable speed and one conveyor carries a heated pusher for applying heat to a wrapper to seal overlapped portions thereof, control of the drive means may allow control of the period so that substantially constant quantities of heat are transferred irrespective of machine speed.

Some or all of the various aspects of the invention may be incorporated in a wrapping machine in any combination. Although the wrapping machine has been described with particular reference to packets, the invention is applicable in all aspects to machines for wrapping or packing other articles (both in and outside the tobacco industry) and reference herein to "packets" and "wrappers" and "wrapping" should be construed accordingly. For example, the invention could be used in the wrapping (i.e. packing) of bundles of cigarettes, i.e. in a cigarette packing machine, or bars of soap.

The invention will be further described, by way of example only, with reference to the accompanying diagrammatic drawings, in which.

Figure 2:
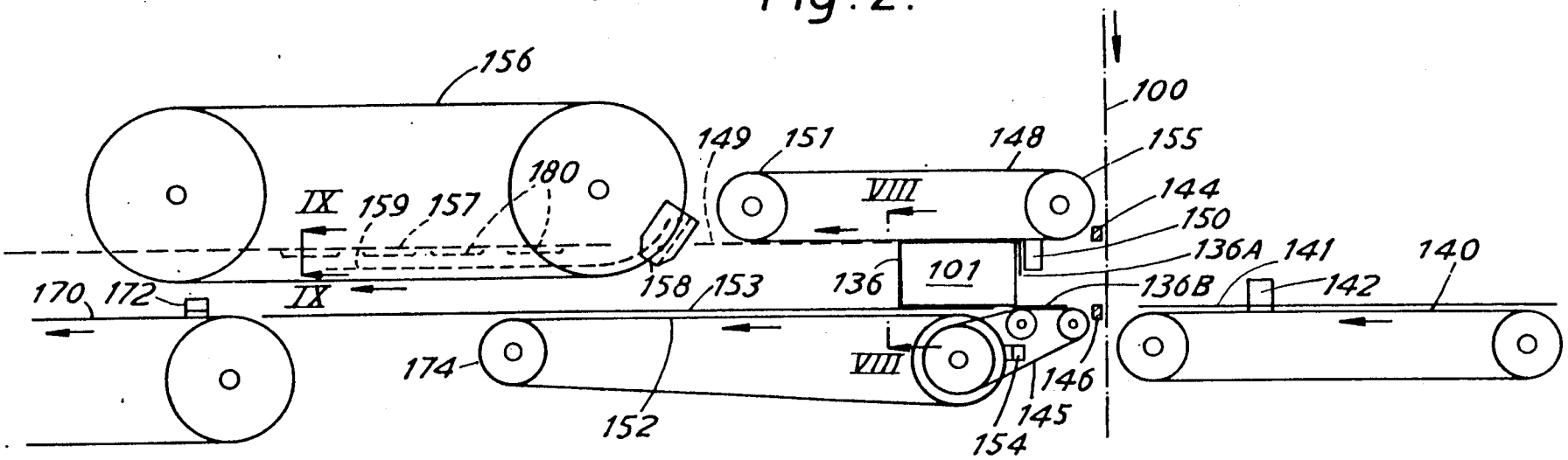
FIG. 2 is a side view of part of a modified wrapping machine.
Figure 5:
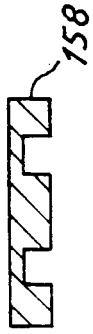
Figure 4:
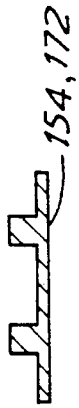
Figure 3:
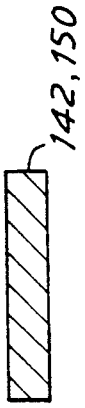
Figure 6:
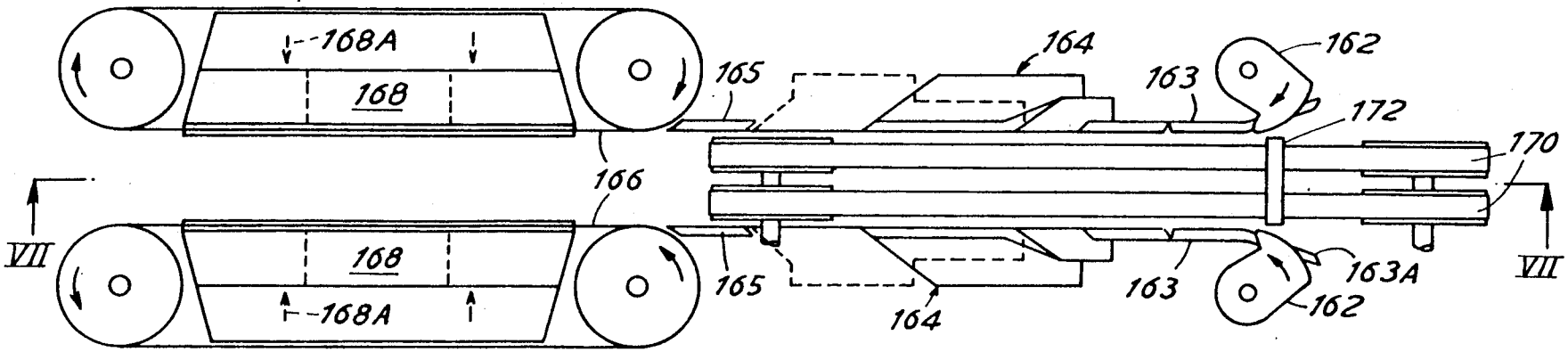
Figure 7:
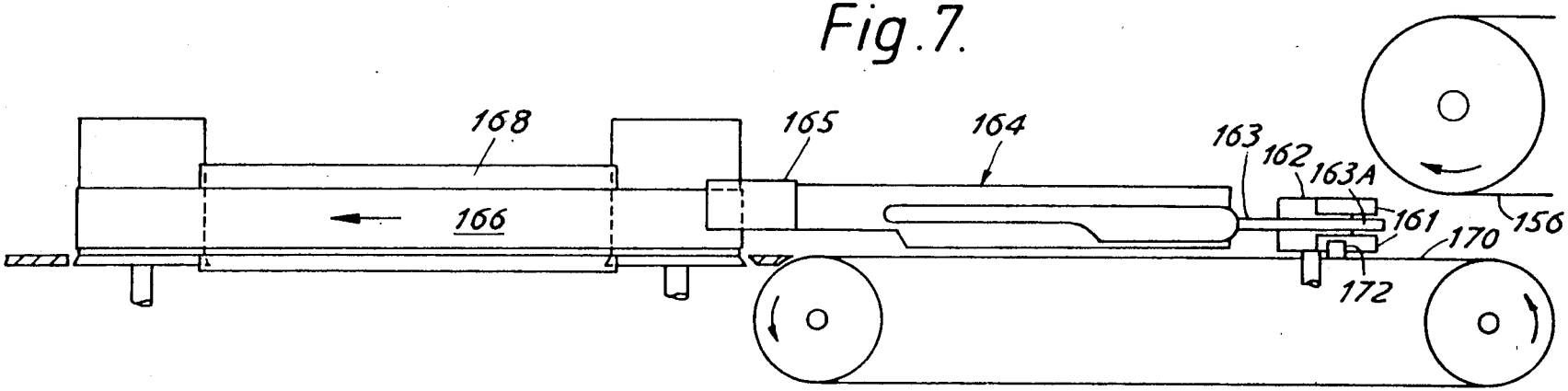
Figure 8:
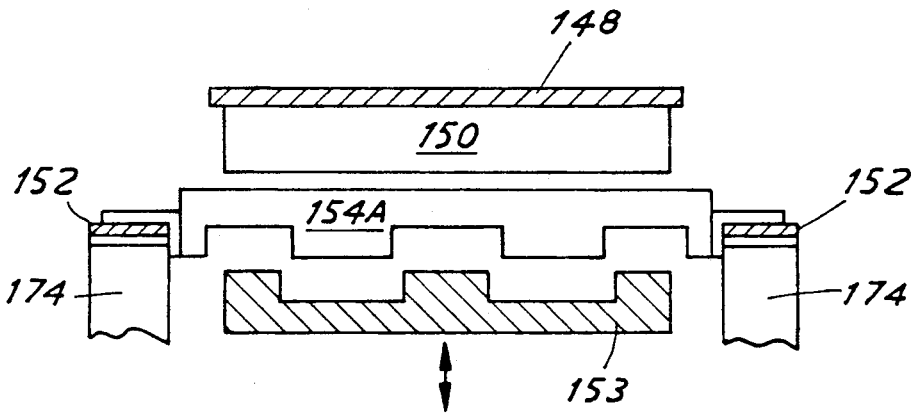
Figure 9:
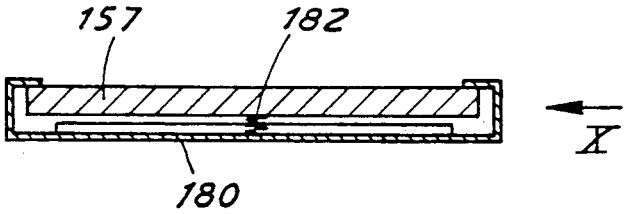
Figure 10:
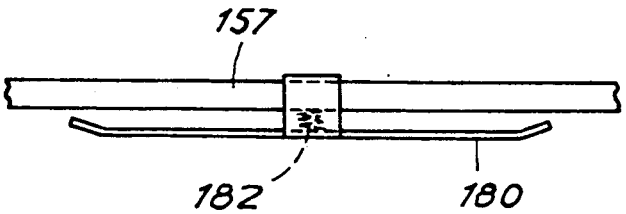

FIGS. 3–5 are transverse sectional views of various pushers in the machine of FIG. 2, FIG. 6 is a plan view of another part of the machine of FIG. 2, FIG. 7 is a part-sectional view on the line VII—VII in FIG. 6, and FIG. 8 is a sectional view of a modified machine on a line corresponding to the line VIII—VIII in FIG. 2, FIG. 9 is a detail sectional view on the line IX—IX in FIG. 2, and FIG. 10 is a view in the direction of arrow X in FIG. 9.

Figure 1:
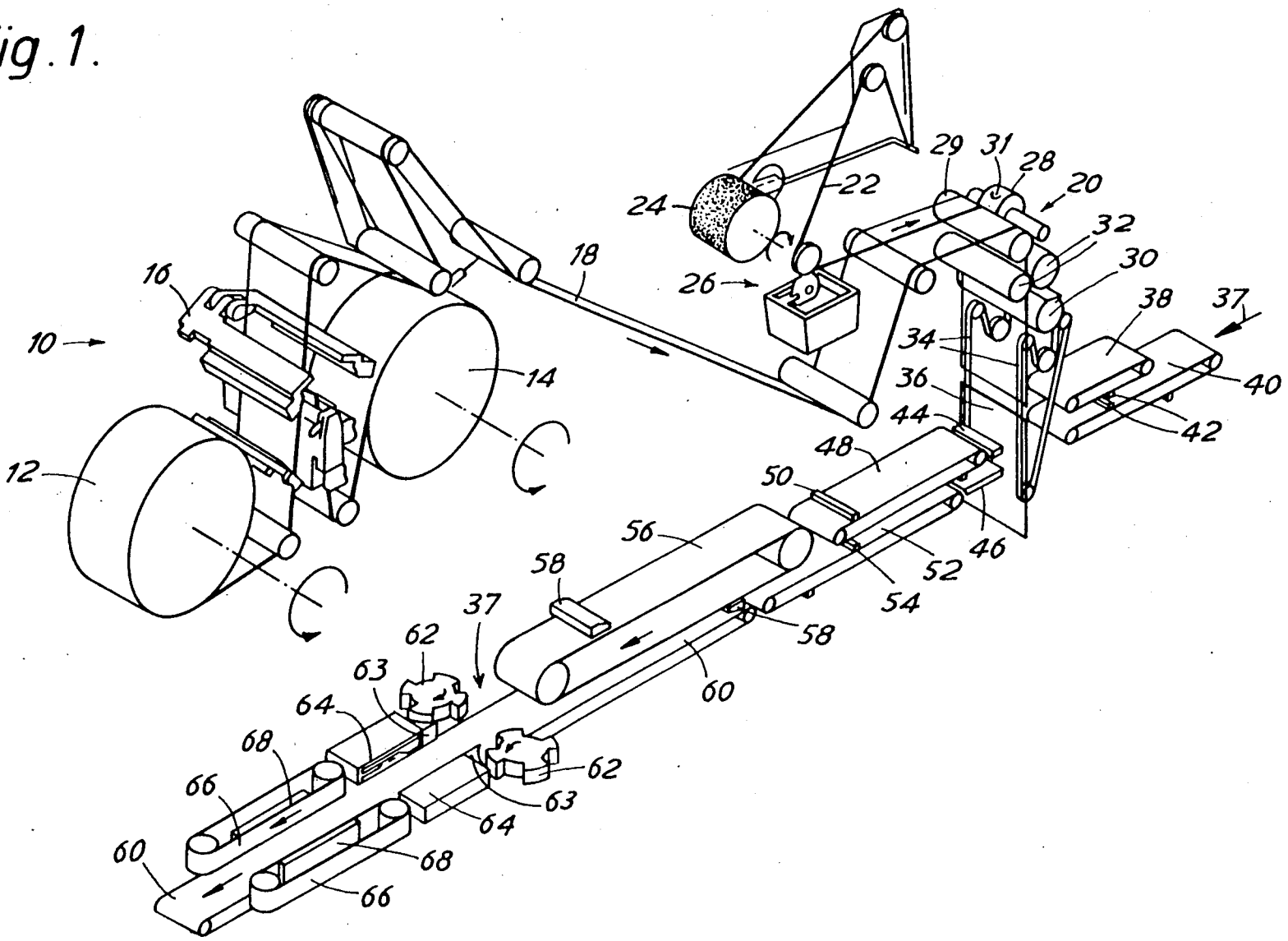
FIG. 1 is a perspective view of a wrapping machine.

FIG. 1 shows a machine for wrapping cigarette packets in a transparent film of thermoplastics material.

The machine includes a film reel unit 10 having carriers for two film reels 12, 14. A splicer unit 16 is provided for joining the trailing end of the film from the reel 12 in use to the leading end of the replacement reel 14 (and, alternately, vice versa).

The film web 18 passes from the film reel unit 10 around several idler and tension rollers to a feed and cutting unit 20. Just upstream of the unit 20 a tear tape 22 is delivered onto the film web 18 from a tear tape reel 24. The tear tape 22 passes a hot wax applicator 26 prior to delivery onto the film web 18. The unit 20 includes a roller 28 and counter roller 29 which together press the tear tape 22 onto the film web 18 so that they are united by the hot wax. The roller 28 includes a narrow cutter 31 for cutting the tear tape 22 and underlying film 18 for producing a tear tab in the completed wrapper.

The feed and cutting unit 20 includes a pair of feed rolls 32 positioned below the rolls 28, 29. The rolls 32 control the speed at which the film web 18 and tear tape 22 are withdrawn from the respective reels 12, 24. Just below the rolls 32 is a rotary cutter 30 which severs successive leading portions of the film web 18 (and attached tear tape 22) to form wrappers 36. The cutter 30 acts against a counter surface or edge (not shown) on the opposite side of the film web 18. Successive wrappers 36 are withdrawn along a substantially vertical path by a pair of laterally spaced feed bands 34 cooperating with a similar pair of bands (not shown) opposed to the bands 34, so that the wrappers are delivered between laterally spaced pairs of bands. The wrappers 36 are withdrawn by the bands 34 at a speed which is somewhat higher than the feed speed of the rolls 32, so that each wrapper becomes spaced from the uncut portion of the film web 18.

The bands 34 deliver each wrapper 36 into the path of a packet (not shown) conveyed along a horizontally extending wrapping line 37. The packets are received on the line 37 on a lower band 40, so that each packet is advanced by a pusher 42 engaging its trailing side. The packets are received on the band 40 from a cigarette packing machine or from an accumulator unit or other handling unit arranged downstream of a cigarette packing machine. If each packet is regarded as having two relatively large faces, two relatively narrow sides and two ends, the orientation of the packets is such that their faces are horizontal with their ends parallel to the direction of movement on the line 37 and, as mentioned, the trailing side of each packet being engaged by a pusher 42.

An upper band 38 is positioned above the downstream part of the band 40. The band 38 carries pushers 42 arranged to cooperate with the pushers 42 on the band 40. The timing of the pushers 42 and the cutter 30 and the relative speeds of bands 34 and bands 38, 40 is such that each wrapper 36 is engaged substantially centrally by the leading side of a packet and plunged between the upper and lower plates 44, 46 located just beyond the path of the wrapper 36 between the bands 34.

The packet thus has its leading side and upper and lower faces enveloped by the wrapper 36 with free ends of the wrapper extending parallel to the upper and lower faces of the packet. The upper free end of the wrapper 36 is engaged by a pusher 50 on an upper band 48 just beyond the plate 44. The pusher 50 folds the upper free end of the wrapper 36 against the trailing side of the packet and conveys the packet further along the line 37.

The downstream part of the upper band 48 overlaps an upstream part of a lower band 52, which runs faster than the band 48. The timing between the pushers 52 and 54 is such that the pusher 54 engages the lower free end of each wrapper 36 and folds it upwards against the trailing side of the packet. The length of the wrapper 36 is such that the lower free end overlaps the upper free end and serves to hold it in place (by means of the pusher 54).

An upper heater band 56 carrying electrically-heated pushers 58 has an upstream part which overlaps the downstream part of the band 52. The band 56 runs faster than the band 54 and the heated pushers 58 engage the trailing side of each packet over the overlapped portions of the wrapper 36. During conveyance of the packet by the pushers 58, sufficient heat is transferred to the thermoplastics material of the overlapped portions of the wrapper to cause those portions to become sealed together.

Downstream of the heater band 56 the packets are conveyed on a lower plain band 60, which runs at the same speed as the heater band 56 and also supports the packets while they are conveyed by the pushers 58.

The packets conveyed by the band 60 downstream of the heater band 56 have open rectangular tubular wrapper portions extending outwards from each end of the packet. Each of these portions has upper and lower face portions and leading and trailing side portions. Rotary folders 62, having a higher peripheral speed than the linear speed of the packets, engage the trailing side portions and fold these against the ends of each packet. Stationary plough folders 63 engage the leading side portions and fold these against the ends of each packet, and also serve to hold the folded trailing side portions in place downstream of the rotary folders 62. Further plough folders 64 then fold first the lower face portions and then the upper face portions of the wrapper over the already folded side portions.

Downstream of the plough folders 64 each packet passes between a pair of driven bands 66 which hold the folded end portions of the wrapper in place and also apply heat from heaters 68 to cause the end folds of each packet to become sealed and so complete the wrapping of the packet.

The wrapped packet is delivered from the end of the band 60 to further processing apparatus, e.g. a boxer or parcelling machine.

FIGS. 2–7 show parts of a modified wrapping machine. The machine is similar in many respects to the machine of FIG. 1.

Delivery of wrappers to and along a vertical path 100 is similar to that of the wrappers 36 in FIG. 1. A lower band 140 carrying equally-spaced pushers 142 (only one of which is shown) feeds successive packets 101 along laterally spaced support surfaces 141 and across the path 100 so that the packet intercepts a wrapper 136 and is received between the upper run of a plain band 145 and the lower run of a band 148 carrying spaced pushers 150 (only one of which is shown). The bands 145 and 148 extend almost up to the path 100 and serve to engage or grip the leading end of the packet 101 (and wrapper 136) very soon after it crosses the path 100. Clearly, because of the curvature of the pulleys, it is not possible for the bands 145, 148 to contact the wrapper 136 immediately after it has been deflected by a packet 101. For this purpose upper and lower guides 144, 146 having slightly curved lower leading edges and defining an aperture only slightly larger than the height of a packet 101 are provided and additionally ensure good initial wrapping of the wrapper 136 around a packet. The drive pulley of the band 145 may be positioned directly below the smaller upper pulleys, instead of coaxially with the upstream pulley of the band 152: this allows use of a full width pusher 154 (i.e. similar to the pusher 154A of FIG. 8), since the possibility of interference with the band 145 is removed.

The linear speeds of the bands 140, 145 and 148 are the same. The timing of the pushers 150 is such that each engages the upper trailing portion 136A of the wrapper 136, folds it along the upper trailing edge of the packet 101 and subsequently holds it against the trailing side of the packet as it pushes the latter along further laterally-spaced support surfaces 153 which start downstream of the short upper run of the band 145. Friction between the lower portion of the wrapper 136 and the surfaces 153 while the portion 136A is held by the pusher 150 against the trailing side of the packet 101 tends to pull the wrapper around the packet and serves to ensure a tight wrap of the wrapper around the packet.

A lower band 152 carrying spaced pushers 154 is arranged downstream of the bands 145. The linear speed of the band 152 is higher than that of the band 148. The pushers 154 are timed so that each engages the lower trailing portion 136B of a wrapper 136 and folds it upwards over the trailing side of the packet 101 and overlapping the previously folded upper portion 136A. The packet 101 is subsequently conveyed on the surfaces 153 by the pusher 154, which holds the overlapped wrapper 136 firmly in place around the packet. The surfaces 153 and the lower surface of the band 148 serve to contact and maintain control and tightness of the wrapper 136 as the packet is conveyed by the pusher 154 in a manner similar to that during conveyance by the pusher 150.

A heater conveyor 156, comprising laterally-spaced chains or bands with spaced heated pushers 158 extending between the bands, overlaps the downstream ends of the surfaces 153 and the band 152. The bands of conveyor 156 are spaced apart by more than the width of the wrapper 136. The conveyor 156 has a higher linear speed than the band 152 and the pushers 158 are arranged so that the trailing side of each packet 101 is engaged by a pusher which takes over conveyance from the pusher 154 of a packet on the surfaces 153. The heated pushers 158 engage the overlapped portions of the wrapper 136 and during conveyance of the packet transfer sufficient heat to cause these portions to become sealed together. The pushers 158 have lateral extensions which pass between upper and lower side members which improve stiffness of the lower run of the conveyor 156 and serve as guides and prevent vertical movement of the pushers during their operative runs.

The pushers 158 are electrically heated and have sliding contacts at their ends which engage stationary side conductors (as indicated at 159). Electrical current to the pushers 158 is preferably controlled so as to maintain an acceptable temperature range (typically 120°–160° C.) at the pushers; this may be achieved by controlling the voltage at which and the period during which the current is applied. The pushers 158 have a relatively high thermal mass.

During conveyance by the pushers 158 the upper portion of the wrapper 136 and packet 101 are under control of a stationary surface 157. The wrapper portion covering the upper face of the packets 101 may be contacted directly by the surface 157. However, it is preferred to resiliently press the packets onto the surfaces 153. For this purpose presser members 180, better shown in FIGS. 9 and 10, are attached to the underneath of surface 157 and have light springs 182 urging them into contact with the packets, which are thus lightly pressed down onto the surfaces 153. Although the lower surfaces of the presser members 180 (of which there may be four in series along the length of the operative run of the pushers 158) and the surfaces 153 are of relatively low-friction material (e.g. stainless steel), the slight additional friction caused by pressing on the packets ensures good contact between each pusher 158 and a packet. The members 180 (or the surface 157) and the surfaces 153 create drag which helps to maintain wrap tightness during conveyance of the packets 101 by the pushers 158 up until the seal is complete.

At its downstream end the heater conveyor 156 overlaps a further lower band conveyor 170 carrying spaced pushers 172. The conveyor 170 has a higher linear speed than the conveyor 156, so that conveyance of packets is transferred from the pushers 158 to the pushers 172.

The ratios of the speeds of conveyors 140 (and 145 and 148): 152: 156: 170 are approximately 1: 1.20: 1.33: 1.40. The spacings between packets (and the pushers on the respective conveyors) are therefore in the same ratios. Each of the conveyors 140, 148, 152, 156, and 170 has four equally-spaced pushers.

It may be an advantage to reduce or eliminate the speed differential between one or more of the successive pairs of pushers 150, 154, 158, 172, and hence between their respective conveyors, so as to reduce impact on the packet 101 and possible consequent slipping of the wrapper 136 relative to the packet. This may be particularly useful at the first transfer, between pushers 150 and 154. In this instance, having conveyors 148 and 152 running at the same speed (which would involve reducing the pitch between pushers 154 to that between pushers 150) would have the further advantage of potentially maximising the period during which the packet 101 and wrapper 136 are dragged over the surfaces 153 and therefore also potentially maximising the benefit this has on wrap tightness and control.

Each of the conveyors 140, 148, 152, 156, 170 comprises timing bands (or belts) and use of these, as opposed to chains, provides greater compliance, and hence also potentially helps to reduce impact on the packets 101. Bands have the further advantage over chains that they can be used to contact the wrapper 136 directly and for control of the wrapper and packet 101, e.g. as by bands 148 and 170, and further allow the possibility of transition between a surface on which the packets slide (e.g. surfaces 153) and a surface (e.g. of band 170) on which the packets are directly conveyed.

The pushers 142 and 150 are of generally plain rectangular sections, as indicated in FIG. 3. The pushers 154, 158 and 172 are of complementary shapes, as indicated in FIGS. 4 and 5, intended to facilitate transfer while allowing adequate contact with the packets, although each of these may similarly be of plain rectangular shape similar to the pushers 142, 150. Note that during transfer between pushers each packet is contacted by both pushers for a short period (or for a longer period if the speed differential is substantially eliminated).

A continuation of the surfaces 153 may extend to the left as shown in FIG. 2, so that the conveyor 170 may be set below the continuation surface in the same way as the band 152 is below the surfaces 153. (The conveyor 170 may preferably comprise a single central band for this purpose instead of the laterally spaced bands as shown in FIG. 6.) Further, an upper slide surface 149 (which could comprise laterally-spaced portions) may be provided in the vicinity of the band 148 so that the pusher 150 extends below it but the surface is below the lower run of band 148 so that it contacts the wrapper 136 on a passing packet 101. The conveyor 148, surface 149 and/or pushers 150 may have laterally-spaced portions to achieve this. The surface 149 would therefore be at substantially the same level as the surface 157. The slight additional friction between the portion of the wrapper 136 around the upper face of a packet 101 and the stationary surface below the band 148 may further assist wrap tightness and control. It may be preferable for the upper control surface 149 to start at or downstream of the position at which pusher 154 first contacts a packet 101. The surface 149 may extend beyond the downstream pulley of band 148 to maintain control of the upper portion of the wrapper 136 as far as possible up to the path of the heated pushers 158.

Referring now particularly to FIGS. 6 and 7, which show a part of the machine mostly downstream of the part shown in FIG. 2, the conveyor 170 moves packets between rotary folders 162 for forming the trailing side end folds of the wrapper. The folders 162 have spaced upper and lower elements 161 (FIG. 7) which, during rotation of the folders 162, respectively pass above and below stationary folders 163 for forming and retaining the leading side end folds and for retaining the trailing side end folds. The folders 163 have lead-in guides 163A extending between the elements 161 of folders 162. The trailing curved faces of the folders 162 serve to hold the trailing side end folds in place until the stationary folders 163 take over. This effect may be enhanced by replacing the folders 162 with short belts carrying folder or tucker blocks having upper and lower elements similar to elements 161. The action of the folders 162 could be assisted by air jets: these could be stationary or could be carried by the folders 162 themselves. Stationary plough folders 164 complete the lower and upper face end folds. Operation of the folders 162, 163 and 164 is substantially similar to that of the folders 62, 63 and 64 of the machine of FIG. 1.

Downstream of the folders 164 side plates 165 hold the folded ends of the wrapper in place during transfer of the packet from the conveyor 170 to opposed conveyor bands 166 which contact the opposite end folds of each packet. The bands 166 are heated by heater blocks 168, which contain electrically-heated cartridge elements, so that the end folds are sealed during passage of the packets between the bands. The material of the bands 166 may typically be steel or PTFE-impregnated glassfibre, the material being selected to have adequate thermal conductivity and resistance to the effects of relatively high temperatures. The heater blocks 168 could comprise separately heated sections (as indicated in FIG. 6) to allow greater control of heat applied to the bands 166. One or more of the sections could be retractable and the sections or blocks 168 could be spring-loaded towards the bands 166 (as indicated at 168A in FIG. 6). This ensures reasonably constant pressure between the blocks 168 and the bands 166 and also between the bands and the packets; and helps to accommodate slight variations in pack length (between ends). The heater blocks 168 could be replaced or supplemented by radiant, e.g. halogen, heaters. Heat may be transferred to (or, exceptionally, removed from) the return runs of the bands 166, to aid temperature control.

It will be understood that each of the conveyors 140, 148, 152, 156, 170 may have a backing member adjacent its operative run to support the conveyor. This may be particularly beneficial where the conveyor bears directly on the conveyed packet 101 (e.g. conveyor 170 as shown in FIG. 2 and conveyor 148 in the absence of surface 149). Theoretically the backing member need not be straight. For example, if the pulleys of the conveyor 148 were set higher than shown in FIG. 2 the operative run of conveyor 148 could be displaced downwardly by an initially convex backing surface arranged to move the pushers 150 progressively into their operative positions. When the surface 149 extends for only part of the length of the lower run of conveyor 148 then the downstream pulley 151 may be set at a slightly higher level than the upstream pulley 155 and the backing member may be initially parallel to the surface 153 (i.e. for some distance downstream of pulley 155) and then be angled upwards slightly towards the pulley 151, thereby guiding the downstream portion of the lower run of conveyor 148 above the surface 149. The pushers 150 preferably contact the wrapper 136 and packet 101 directly from the pulley 155 with no deflection of the lower run of the conveyor 148, at least upstream of the surface 149.

One advantage of the machine is that no adjustment of the packet conveying conveyors is necessary for change in packet width (i.e. between sides of the packet), since timing is by reference to the trailing side of a packet. Changes in packet length may also be relatively easily accommodated, e.g. by moving apart laterally spaced bands. The effect on the machine of changes in packet height (i.e. between faces) may be reduced if it is arranged that adjustment of stationary as opposed to moving parts is required. Thus, referring to FIG. 8, which is a sectional view of a slightly modified arrangement on a line corresponding to the line VIII—VIII in FIG. 2, the surface 153 is moved vertically to adjust its distance from the lower run of conveyor 148 (and from surface 149). The positions of the conveyors 148 and 152 remain unchanged. Note that the height of the top of the pusher 154A above the diameter of downstream pulley 174 around which conveyor 152 passes is small (e.g. 3 mm): this reduces acceleration of the packet on surface 153 as the pusher rounds the pulley at the end of its operative run.

At least some size changes could be automated. Sizes, or codes referring to known packet sizes, could be keyed into a control microprocessor. Alternatively a reference packet could be monitored, e.g. by opto-electronic sensors incorporated on or adjacent the machine, so that a control system sets appropriate size-related adjustments on the machine following monitoring, e.g. following insertion of the reference packet into a monitoring pocket in which it is monitored. Further sensors at the monitoring position could cooperate with corresponding sensors for packets after wrapping to ensure equivalence: this feature could also be used with a packing machine where it could serve to check that the packet being produced had the same printing etc. as the reference packet.

It will be appreciated that the relative timing of the conveyors is critical, particularly where conveyance of packets is transferred between conveyors. The conveyors may be driven from a common prime mover with appropriate gearing. Alternatively, independent drives which are electrically controlled to maintain timing may be used. In the machine of FIGS. 2–7 a combination of these is used. The trailing pulleys of conveyors 148, 152, and 156 and leading pulleys of conveyors 140 and 145 are driven from a first common prime mover. A second common prime mover drives the leading pulleys of conveyor 170, the trailing pulleys of bands 166 and the rotary folders 162.

An advantage of providing independent drives is that where conveyors overlap the position at which the downstream conveyor takes over conveyance of the packet may readily be controlled by adjustment of the relative phasing of the drives to alter the relative positions of the pushers of the respective conveyors. This would be much more difficult with conventional drive arrangements where each conveyor would be linked to a common prime mover. Thus, in the case of conveyors 156 and 170 for example, these conveyors may be arranged to be independently driven and to overlap by a rather greater amount than shown in FIG. 2. Then the relative phasing of the drives may be altered (during a period when the machine is idle), so that pusher 172 takes over conveyance of packets 101 from pusher 158 earlier or later. In this way the period during which the packet 101 is contacted by a heated pusher 158 may be adjusted. This is a useful facility, particularly where the machine may be run at variable speeds, since it may be possible in this way to maintain the period of contact with the pusher 158 relatively constant at different machine speeds or otherwise to control this period as required. It is also possible to easily vary the relative speeds of successive conveyors having independent drives but this would normally require replacement at least of one of the conveyors since the spacing between pushers of a conveyor is related to conveyor speed, i.e. the pitch between packets varies with speed of conveyance.

It may be noted that a slight speed error may occur during the period when the pusher 142 is still in contact with a packet 101 and starts to move around the downstream pulley of conveyor 140. One way of overcoming this problem is to control the speed of conveyor 140 so that it is slightly slowed during this period to compensate for the otherwise increased speed of the packet. Clearly the use of an independent electronic drive for the conveyor 140 facilitates this. An alternative way of dealing with the same problem would be to provide the pusher 142 with a leading surface which slants backwards from the conveyor. Another possibility would be to use a so-called tip-back pusher conveyor or, more simply, provide parallel belt conveyors with links between them to keep the pusher vertical. It may even be possible to arrange for the conveyor 140 to move slightly slower than the conveyors 145 and 148, so that as soon as a packet is gripped by these latter conveyors it is moved away from the pusher 142. The problem may be reduced without recourse to speed adjustment or a relatively complicated pusher construction by minimising the height of the pusher above the effective diameter of the downstream pulley, as mentioned above with reference to FIG. 8.

We claim:

1. A wrapping machine for wrapping articles in succession including:

means for conveying said articles in succession and in spaced relationship at a predetermined speed along a path, means for delivering wrappers in succession to said articles, including means for locating a first part of each said wrapper with respect to one of said articles moving on said path whereby each wrapper is associated with an article, and means adapted to cause relative movement of a second part of the wrapper with respect to the associated article so as to cause the wrapper to be tightened around at least part of the article, said means adapted to cause relative movement of the wrapper comprising means providing at least one surface, adapted to move generally in the direction of said path at a speed which differs from said predetermined speed of said article, for engaging said second part of said wrapper, said at least one surface being adapted to provide sufficient friction between said at least one surface and said second part of said wrapper to cause drag on said second part of said wrapper.

2. A wrapping machine as claimed in claim 1, wherein the locating means comprises part of said means for conveying the article along said path.

3. A wrapping machine as claimed in claim 2, wherein the locating means comprises a pusher.

4. A wrapping machine as claimed in claim 2, wherein the locating means includes means for wrapping part of the wrapper around said article.

5. A wrapping machine as claimed in claim 4, wherein the locating means is adapted to wrap said first part of the wrapper around an article.

6. A wrapping machine as claimed in claim 3, wherein the locating means includes heat transfer means arranged to contact an overlapped portion of the wrapper including said first part.

7. A wrapping machine as claimed in claim 1, including at least two of said surfaces, said surfaces being spaced so that articles on said path pass between them and so that different parts of a wrapper may be contacted substantially simultaneously by said surfaces.

8. A wrapping machine as claimed in claim 1, including at least one pusher for advancing a partially-wrapped article along said path, said pusher including means for sealing an overlapped portion of the wrapper during conveyance of the article by transfer of heat between the pusher and said portion.

9. A wrapping machine as claimed in claim 1, including a first pusher for moving an article along said path, and a second pusher for moving an article along said path, said second pusher being arranged to take over conveyance of an article on said path from said first pusher.

10. A wrapping machine for wrapping articles in succession, including:

means for conveying said articles in succession and in spaced relationship along a path, means for delivering wrappers in succession to said articles, including means for locating a first part of each said wrapper with respect to one of said articles moving on said path whereby said wrapper is associated with an article, means adapted to cause relative movement of a second part of the wrapper with respect to the associated article so as to cause the wrapper to be tightened around at least part of the article, said means adapted to cause relative movement of the wrapper comprising means providing at least one surface relative to which said second part of the wrapper is caused to move during movement of the article along said path, said at least one surface being adapted to provide sufficient friction between said at least one surface and said second part of said wrapper to cause drag on said second part of said wrapper, and resilient means for applying pressure between said at least one surface and said article to increase said drag on said second part of said wrapper.

11. A wrapping machine as claimed in claim 10, including a support surface, a movable plate between which and said support surface an article is movable along said path, and resilient means for urging the plate into contact with part of a partially-wrapped article on said path, so that the article is lightly pressed between said movable plate and said support surface.

12. A wrapping machine as claimed in claim 10, wherein said means for delivering wrappers is adapted to deliver said wrappers to said articles at a predetermined position along said path and said conveying means comprises opposed conveyors downstream of said predetermined position and adapted to substantially simultaneously engage successive packets in turn.

13. A wrapping machine as claimed in claim 11, wherein said means for delivering wrappers is adapted to deliver said wrappers to said articles at a predetermined position along said path, including opposed stationary guides arranged substantially downstream of said predetermined position, said guides being arranged to define an aperture through which each article and associated wrapper is conveyed by said conveying means and being spaced so as to cause initial wrapping of said wrapper around said article.

14. A wrapping machine for wrapping articles in succession including:

means for conveying said articles in succession and in spaced relationship along a path, means for delivering wrappers in succession to said articles, including means for locating a first part of each said wrapper with respect to one of articles moving on said path whereby each wrapper is associated with an article, means adapted to cause relative movement of a second part of the wrapper with respect to the associated article so as to cause the wrapper to be tightened around at least part of the article, and a first pusher for moving an article along said path and a second pusher for moving an article along said path, said second pusher being arranged to take over conveyance of an article on said path from said first pusher, said first and second pushers having complementary shapes to allow each to have simultaneous contact with different parts of said article.

15. A wrapping machine, for wrapping articles in succession, including:

means for conveying said articles in succession and in spaced relationship along a path, means for delivering wrappers in succession to said articles, including means for locating a first part of each said wrapper with respect to one of said articles moving on said path whereby each wrapper is associated with an article, means adapted to cause relative movement of a second part of the wrapper with respect to the associated article so as to cause the wrapper to be tightened around at least part of the article, successive conveyors for conveying articles along said path, including independent drives for each of said conveyors and means for controlling at least one of said drives so that at least one of the phase and speed of said conveyors may be varied, so that the position at which an article is transferred between said conveyors may be varied.

16. A wrapping machine including means for moving a succession of spaced packets continuously along a path, and means for delivering a succession of wrappers across said path at a predetermined position along said path, in timed relationship to said packets so that each wrapper is intercepted by a packet and said packet becomes partially wrapped by said wrapper as said packet and wrapper move downstream of said predetermined position, wherein said moving means comprises opposed conveyors substantially immediately downstream of said predetermined position where the packets intercept the wrappers, so that each partially wrapped packet is engaged on opposed surfaces by said conveyors.

17. A wrapping machine, including means defining a substantially straight path along which packets are moved continuously in succession, means for delivering a succession of wrappers so that each wrapper is intercepted by a packet moving on said path, and means for folding and sealing the wrapper around the packet, including a first pusher for moving a packet along said path, and a second pusher for moving a packet along said path, said second pusher being arranged to take over conveyance of a packet on said path from said first pusher, and said first and second pushers having complementary shapes to allow each to have contact with different parts of said packet.

* * * * *